United States Patent [19]

Fehler

[11] 3,968,644

[45] July 13, 1976

[54] FUEL ADMITTING AND CONDITIONING MEANS ON COMBUSTION CHAMBERS FOR GAS TURBINE ENGINES

[75] Inventor: Adolf Fehler, Pfaffing, Germany

[73] Assignee: Motoren- und Turbinen-Union, Munchen GmbH, Germany

[22] Filed: Aug. 19, 1974

[21] Appl. No.: 498,662

[30] Foreign Application Priority Data

Aug. 18, 1973 Germany ..... 2341904

[52] U.S. Cl. ..... 60/39.65; 60/39.74 R; 431/352; 431/176

[51] Int. Cl.[2] ..... F02C 7/22

[58] Field of Search ..... 60/39.74 R, 39.65; 431/351, 352, 176

[56] References Cited

UNITED STATES PATENTS

| | | | |
|---|---|---|---|
| 2,552,851 | 5/1951 | Gist | 60/39.74 R |
| 2,720,081 | 10/1955 | Tutherly | 60/39.65 |
| 2,851,859 | 9/1958 | Foure | 60/39.74 R |
| 3,074,668 | 1/1963 | Frenzl | 60/39.74 R |
| 3,099,134 | 7/1963 | Calder et al. | 60/39.65 |
| 3,290,880 | 12/1966 | Poyser | 60/39.65 |
| 3,451,216 | 6/1969 | Harding | 60/39.74 R |

FOREIGN PATENTS OR APPLICATIONS

| | | | |
|---|---|---|---|
| 1,242,644 | 8/1971 | United Kingdom | 60/39.74 R |
| 765,327 | 1/1957 | United Kingdom | 60/39.74 R |
| 627,644 | 8/1949 | United Kingdom | 60/39.65 |

*Primary Examiner*—William L. Freeh
*Assistant Examiner*—Robert E. Garrett
*Attorney, Agent, or Firm*—Craig & Antonelli

[57] ABSTRACT

Apparatus for supplying air and fuel to a flame tube of a combustion chamber of a gas turbine engine which includes primary air supply ports for supplying air under high pressure toward the center of the flame tube and fuel tubes projecting into and opening at the primary supply ports for admitting fuel for entrainment by the primary air as it passes through the primary supply ports. In certain preferred embodiments, an annular member forms a supply port, as well as a mounting arrangement for fuel tube. Preferred embodiments also include deflector baffles or plates for preventing flow of fuel from the fuel tubes into portions of the air being supplied as secondary air to the combustion chamber.

25 Claims, 5 Drawing Figures

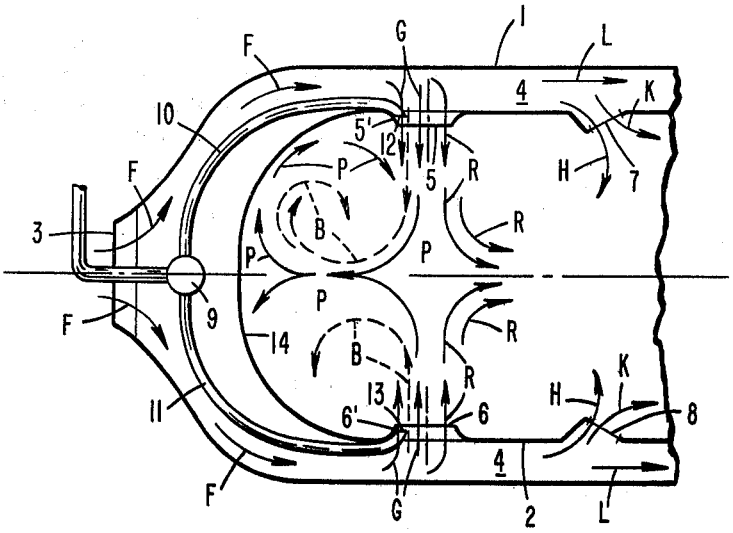
FIG. 1
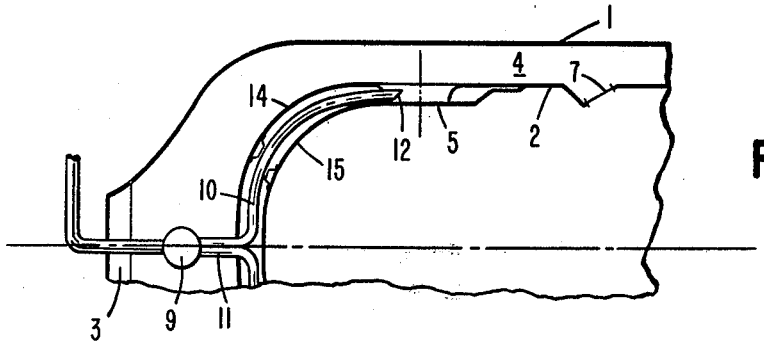
FIG. 2
FIG. 3
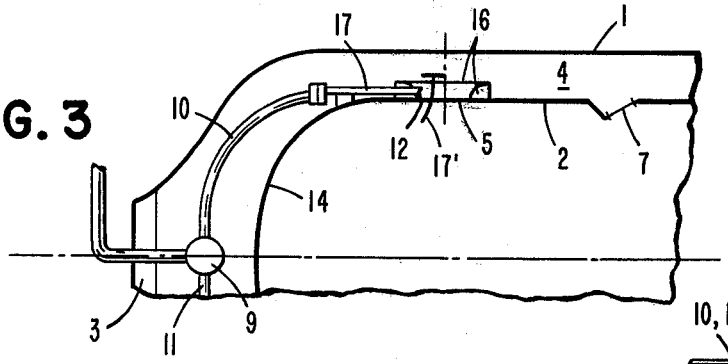
FIG. 4
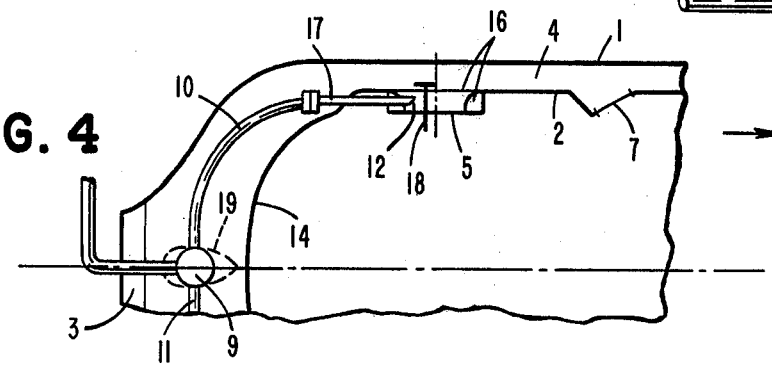
FIG. 5
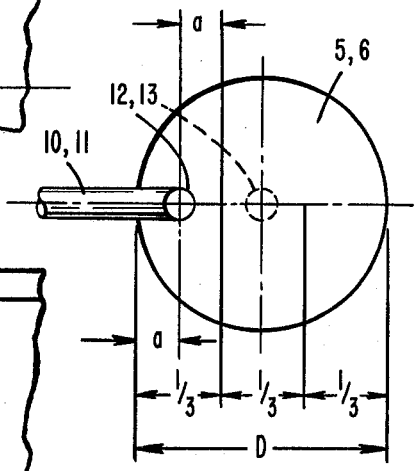

FUEL ADMITTING AND CONDITIONING MEANS ON COMBUSTION CHAMBERS FOR GAS TURBINE ENGINES

BACKGROUND AND SUMMARY OF THE INVENTION

The present invention relates to fuel admitting and conditioning means on combustion chambers for gas turbine engines, where the respective flame tube of a combustion chamber is provided in the upstream area with circumferentially equally spaced primary air supply ports.

With known embodiments of combustion chambers for gas turbine engines, the fuel is finely atomized under great pressure by means of known simplex or duplex nozzles and is injected into the primary zone where it is conditioned, i.e., transformed to a vapor state for subsequent combustion, or it is admitted into the primary zone by means of air-operated atomizer nozzles, where air is admixed to the fuel often while still in the nozzle so as to expedite the conditioning process.

For admitting and conditioning fuel it is also known practice to employ various types of vaporizing burners, in which the fuel is transformed into a gaseous state, as a result of the elevated wall temperature caused by the combustion process and of the flow conditions, and is premixed with air.

These known fuel injecting and conditioning devices, however, are all characterized in that combustion generaly proceeds from one point and that, therefore, forcible mixing processes and related devices are needed to achieve a uniform combustion chamber outlet temperature profile.

This type of spot injection further requires relatively long combustion chambers to achieve spatially uniform fuel conditioning for uniform combustion, or it requires intensive swirling in the primary zone of the fuel and air contents to force relatively uniform combustion while still in the primary zone, although this boosts the pressure losses and, thus, impairs the engine performance.

In a broad aspect the present invention provides a fuel admitting and conditioning means which eliminates the disadvantages in the previously cited means, reduces the installed length of the combustion chamber for less installed volume and, thus, less weight of a gas turbine engine, and achieves a more uniform temperature profile at the turbine exit by optimally conditioning the fuel/air mixture.

The means provided by this invention further enables a greater load to be imposed on the combustion chamber than could be imposed heretobefore.

The present invention contemplates providing fuel admitting and conditioning means where the fuel is admitted through fuel tubes projecting from above or laterally into primary air supply ports. In this manner, the fuel is entrained by the primary air as it passes through the primary air supply ports.

These and further objects, features and advantages of the present invention will become more obvious from the following description when taken on connection with the accompanying drawings which show, for purposes of illustration only, several embodiments in accordance with the present invention.

BRIEF DESCRIPTION OF THE DRAWINGS

FIG. 1 is a schematic longitudinal sectional view of a combustion chamber section illustrating a first embodiment of the apparatus arranged in accordance with the present invention;

FIG. 2 is a schematic longitudinal sectional view of a combustion chamber section illustrating a second embodiment of apparatus arranged in accordance with the present invention;

FIG. 3 is a schematic longitudinal sectional view of a combustion chamber section illustrating a third embodiment of apparatus arranged in accordance with the present invention;

FIG. 4 is a schematic longitudinal sectional view of a combustion chamber section illustrating a fourth embodiment of apparatus arranged in accordance with the present invention; and FIG. 5 is a schematic view showing preferred positions for fuel outlet ports with respect to the cross-section opening of primary air supply ports in accordance with the present invention.

DETAILED DESCRIPTION OF THE DRAWINGS

The combustion chambers illustrated in FIGS. 1 to 4 essentially consist of an outer casing 1 enveloping a flame tube 2. The walls of the outer casing 1 and of the flame tube 2 extend coaxially to the longitudinal centerline of a gas turbine engine and thus represent complete annular combustion chamber. The remaining structure of the gas turbine engine is not illustrated so as not to obscure the present invention. Those skilled in the art, given the present disclosure and the state of the art, will be able to practice the invention.

The inventive concepts also apply to engines with individual combustion chambers consisting of an outer casing and a flame tube insert therein with several of these chambers equally spaced coaxially to the centerline of the engine, or to can-annular combustion chambers where, e.g., several individual flame tubes disposed coaxially to the centerline of the engine are arranged within a common annular outing casing.

With reference now to FIG. 1, compressed air discharged from an unillustrated compressor of the gas turbine engine enters, in the direction of arrowheads F, an annulus 4 formed between the outer casing 1 and the flame tube 2 through an inlet diffusor 3 of the annular combustion chamber.

A portion of the compressor air flows, in the direction of arrowheads G, into the flame tube 2 through primary air supply ports 5, 6 for use as primary air, while a further portion of the compressor air flows, in the direction of arrowheads H and K, into the flame tube 2 through downstream ports 7, 8 in the flame tube 2 for use as secondary air and for cooling the wall of the flame tube, respectively. The primary air supply ports 5, 6 are spaced equally and diametrically opposite over the entire circumference of the flame tube 2.

A still remaining portion of the compressor air (arrowhead L) is admitted in the flame tube 2, perhaps near the downstream end of the annular combustion chamber, to mitigate the combustion outlet temperature or to achieve a desirable temperature profile at the combustion chamber exit radially as well as circumferentially. About 25 percent of the compressor air directed to the combustion chamber is expended for use as primary air.

In accordance with the present invention, fuel tubes 10, 11 extending from an annular fuel manifold 9 project, with their respective outlet ports 12, 13 from outside into funnel-shaped primary air supply ports 5, 6 such that the outlet ports 12, 13 are arranged directly at or somewhat behind that portion 5′ or 6′ of the wall of a primary air supply port 5, 6 which is closest to the upstream end wall 14 of the combustion chamber.

The streams (arrowheads G) of primary air admitted during engine operation under relatively great pressure through the primary air supply ports 5, 6 converge near the center of the flame tube to produce rotational swirls (indicated by arrowheads P) in the upstream area of the flame tube, while the remaining portion of the compressor air admitted through the primary air supply ports 5, 6 flows along a path approximately indicated by arrowheads R to provide mixing (secondary) air for especially the central portion of the flame tube.

The relative high-pressure primary air (sequence of arrows G, P) takes the relatively low-pressure fuel (arrowheads B) with it such that the fuel is essentially imbedded or entrained in the primary air bypassing it.

This above-described pattern also occurs in the interaction between the fuel/air contents admitted through the primary air supply ports 6.

The so shown and described fuel/air admission (arrowheads G, P, B) greatly promotes the intimate, intensive mixing of the primary air with the fuel admitted, especially so as it provides a relatively large mixing surface between the incoming compressor air and the incoming fuel. This is again assisted by the prevailing difference in velocities between the compressor air supplied through the primary air supply ports 5, 6 at a rate of, say, 50 m/sec and the fuel supplied at a rate of, say, 1 m/sec.

The apparatus described herein thus produces, for each two primary air supply ports 5, 6, two rotational swirls formed from intensively conditioned fuel/air mixture in the sequence of arrowheads G, P, B which essentially fill the entire zone between the arched upstream end wall 14 of the combustion chamber and the primary air supply ports 5, 6.

A further advantage in the promotion of a flame front which spreads uniformly over the entire circumference of the combustion chamber is seen to lie in that the swirls composed of fuel and air contents are so closely together that they will collide, viewed in both the radial and the circumferential directions of the combustion chamber.

The area of collision is the zone of maximum turbulence which in accordance with the present invention is employed to assist the conditioning of fuel and the stabilization of flame.

Admission of the air/fuel along the arrowheads G, P and B further serves to maintain the upstream end wall 14 of the combustion chamber at a relatively low temperature. Uniform distribution of the fuel prevents rich zones, which cause carbon to form, and it largely prevents the deposition of fuel particles on the end wall 14 of the combustion chamber and with it the risk of carbonization of fuel particles and, thus, of soot.

The present invention provides a further essential benefit in that (owing to exploitation of the entire length of recirculation) the incoming fuel/air contents are intensively conditioned using a relatively short axial distance for short length of the combustion chamber without making resort to the mechanical means normally used with combustion chambers for producing swirling motion and stabilizing the flame (flameholder).

As a further advantage of the present invention, especially with a view to FIG. 1, a conventional combustion chamber can be retrofitted with little difficulty technically to incorporate the means described, although the only advantage that would here come to bear would be that of improved combustion process, whereas the advantage of reduced overall length of combustion chamber could not be realized without a corresponding modification of the combustion chamber length.

As a further important advantage of the present invention, fuel is admitted without the use of the atomizer nozzles required for conventional injection systems, and large fuel quantity ratios which in modern engine practice run between 1:30 and 1:40 can be processed without difficulty.

Using the same references for similar parts, FIGS. 2 to 4 illustrate other preferred embodiments of the present invention which are variants of FIG. 1 and which exemplify further objects and advantages of the present invention.

In FIG. 2 the flame tube 2 is lined in the upstream area with an additional inner wall 15 to reduce the radiation of heat to the outside.

In FIG. 2 the fuel tubes 10, 11 are shifted to the respective space intervening between the flame tube 2, or the end wall 14 of the flame tube, and the inner wall 15 and are laterally carried into the funneling area of the primary air supply ports 5, 6, where for clarity this is here shown with reference to only one primary air supply port 5.

Installation of the fuel supply tubes 10, 11 could be performed at the time of manufacture of the combustion chamber. Incorporation of the fuel tube 10, 11 in the flame tube 2 provides the further advantage that the fuel can be preheated and blown in its gaseous state into the flame tube 2, which will further intensify the fuel/air mixture conditioning process.

With reference now to FIG. 3, the primary air supply ports, such as 5, are associated with annular members 16 extending coaxially to them, which are here attached externally to the flame tube 2 and are provided with a line connector 17 for connection to a fuel tube 10, and which incorporate an arched baffle 17′ projecting into the flame tube.

FIG. 4 departs from FIG. 3 in that the annular member 16 is arranged within the flame tube 2 and is additionally provided with straight reflector plate 18. This reflector plate 18, as does the baffle 17′ (FIG. 3), prevents the incoming fuel from penetrating the air streams (arrowheads G, P) in which it is entrained or imbedded, which would otherwise inadvisably carry fuel into the admixing air (arrowheads R, H, K) which is not involved in the combustion process.

The inventive apparatus of FIGS. 2 to 4 admits and conditions the air/fuel contents (arrowheads G, P, B) as previously fully described in the light of FIG. 1. However, in FIGS. 2 to 4 the outlet ports 12, 13 for the fuel open laterally or transversely to the flow of primary air in the supply ports, 5, 6.

As indicated in broken line at 19 in FIG. 4, the respective fuel manifold 9 of a combustion chamber can be faired using a flow-promoting blade-like profile.

In the implementation of the invention, it is important with respect also to the alternative embodiments of FIGS. 2, 3 and 4 that the fuel tubes 10, 11 (FIG. 2) or 17 (FIGS. 3 and 4), laterally project into the primary air supply ports, such as 5, with little more than their respective fuel outlet port, such as 12, so as to ensure that the fuel (arrowheads B) is embedded or entrained within the primary air streams (arrowheads G, P).

Referring to FIG. 5, the perferred zone for the openings 12, 13 of the fuel tubes 10, 11 is approximately in the half *a* of the first third of the diameter D in the direction parallel to the combusted chamber access. The dashed lines in FIG. 5 show the preferred outermost limit for positioning of the fuel openings 12 and 13, which position is approximately congruent with the center of the primary air feed bores 5 or 6.

By way of example to aid those skilled in the art in practicing the invention, and not by way of limitation, the following exemplary dimensions are given. With an annular combustion chamber of the type shown in FIG. 1, 4, respectively, 22 primary air feed bores 5 are provided on the outer diameter and 22 primary air feed bores 6 are provided on the inner diameter of the frame tube 2 (it being noted that the drawings illustrate a section of the annular frame tube 2). Each bore 5 and 6, respectively, is associated with a fuel tube 10, 11 such that each bore 5 or 6 has only one fuel feed bore 12 or 13. The bores 5 on the outer diameter of the annular combustion chamber can have a diameter of 16 milimeters with the bores 6 on the inner diameter having a diameter of 14 milimeters. The openings 12, 13 of the fuel tubes could then have a diameter of 5 milimeters.

The invention further contemplates an arrangement where the fuel tubes 10, 11, 17 are used to admit liquid or gaseous fuel or a fuel/air mixture.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Combustion chamber apparatus for a gas turbine engine comprising:

an external engine casing, a flame tube inserted in said engine casing such that an annular chamber is formed between the flame tube and the engine casing, means for supplying primary combustion air and secondary mixing air to said annular chamber, primary supply ports disposed at respective facing opposite sides of said flame tube for directing primary air from said annular chamber into said flame tube, and fuel tubes projecting respectively into each of said primary supply ports for admitting fuel at low pressure and velocity for entrainment by portions of said primary air passing through said primary supply ports, wherein said flame tube has an upstream end wall spaced upstream a small distance from said primary supply ports with respect to the flow of gases through said flame tube, wherein each of said primary supply ports are formed by wall means surrounding a primary port centerline of the respective primary supply port, each of said primary port centerlines extending in the direction of flow of primary air through the associated primary supply port toward the center of the flame tube, and wherein each of said fuel tubes terminate and open into said primary supply ports only at the side of said primary port centerlines closest to the upstream end wall of said flame tube in such a manner that collision of primary air flow portions at the upstream sides of said supply ports from respective facing primary supply ports causes primary zone eddies to be formed recirculating approximately from the center of the flame tube toward said upstream end wall with said fuel from said fuel tubes being embedded in and mixed with the primary air portions in said primary zone eddies, and that the remaining portions of the primary air flow through said primary supply ports is deflected as mixing air in the region of the center of the flame tube which flows in the downstream direction of said flame tube.

2. Apparatus according to claim 1, wherein said primary supply ports are equally spaced about the circumference of the flame tube.

3. Apparatus according to claim 1, wherein said fuel tubes are configured to provide fuel streams to said primary supply ports in the direction of flow of primary air through the respective associated primary supply ports.

4. Apparatus according to claim 1, wherein said fuel tubes are configured to provide fuel streams to said primary supply ports in a direction transverse to the direction of flow of primary air through the respective associated primary supply ports.

5. Apparatus according to claim 1, wherein said fuel tubes are routed externally along the surface of said flame tube.

6. Apparatus according to claim 1, wherein said fuel tubes are installed in the flame tube.

7. Apparatus according to claim 1, wherein the fuel tubes and at least a section of respective fuel supply lines leading to said fuel tubes are installed in annular members arranged coaxially at the respective primary supply ports.

8. Apparatus according to claim 5, wherein the fuel tubes and at least a section of respective fuel supply lines leading to said fuel tubes are installed in annular members arranged coaxially at the respective primary supply ports.

9. Apparatus according to claim 7, wherein said annular members are arranged outside the flame tube.

10. Apparatus according to claim 7, wherein said annular members are arranged inside the flame tube.

11. Apparatus according to claim 7, wherein said annular members are manufactured as a unit with the flame tube.

12. Apparatus according to claim 7, wherein the crosssectional areas of flow of the respective annular members are shaped externally and internally as an inverted cone pointing in the direction of the primary air stream.

13. Apparatus according to claim 1, wherein a deflector plate is arranged between the outlet ends of each of the respective fuel tubes and the transverse center plane of the associated primary supply port, said deflector plate extending substantially parallel to the direction of flow of primary air through said primary supply port and projecting into said flame tube, said deflector plate preventing flow of fuel to secondary air being supplied to said flame tube.

14. Apparatus according to claim 7, wherein a deflector plate is arranged between the outlet ends of each of the respective fuel tubes and the transverse center plane of the associated primary supply port, said deflector plate extending substantially parallel to the direction of flow of primary air through said primary supply port and projecting into said flame tube, said deflector plate preventing flow of fuel to secondary air being supplied to said flame tube.

15. Apparatus according to claim 14, wherein each deflector plate forms part of one of said annular members.

16. Apparatus according to claim 1, wherein an arched baffle is arranged between the outlet end of each of the respective fuel tubes and the transverse center plane of the associated primary supply port, said baffle extending from adjacent said outlet end of the respective fuel tube and projecting into said flame tube for preventing flow of fuel to secondary air being supplied to said flame tube.

17. Apparatus according to claim 7, wherein an arched baffle is arranged between the outlet end of each of the respective fuel tubes and the transverse center plane of the associated primary supply port, said baffle extending from adjacent said outlet end of the respective fuel tube and projecting into said flame tube for preventing flow of fuel to secondary air being supplied to said flame tube.

18. Apparatus according to claim 17, wherein each arched baffle forms part of one of said annular members.

19. Apparatus according to claim 1, wherein the velocity of said fuel at respective outlets of said fuel tubes is substantially less than the velocity of the flow of primary air through said primary supply ports.

20. Apparatus according to claim 19, wherein said velocity of said fuel is approximately 1 meter per second and said velocity of the flow of primary air is approximately 50 meters per second.

21. Apparatus for supplying air and fuel to a flame tube of combustion chamber means of a gas turbine engine, said apparatus comprising:

primary supply ports disposed at opposite sides of the flame tube for directing primary air toward the center of the flame tube, and fuel tubes projecting into and opening at said primary supply ports for admitting fuel for entrainment by said primary air passing through said primary supply ports, wherein said flame tube has an upstream end wall spaced from said primary supply ports, wherein each of said primary supply ports are formed by wall means surrounding a primary port centerline of the respective primary supply port, each of said primary port centerlines extending in the direction of flow of primary air through the associated primary supply port toward the center of the flame tube, and wherein each of said fuel tubes terminate and open into said primary supply ports at the side of said primary port centerlines closest to the upstream end wall of said flame tube.

22. Apparatus according to claim 21, wherein each of said fuel tubes terminate and open into said primary supply ports immediately adjacent the portion of said wall means disposed closest to the upstream end wall of said flame tube.

23. Apparatus according to claim 21, wherein the fuel tubes and at least a section of respective fuel supply lines leading to said fuel tubes are installed in annular members arranged coaxially at the respective primary supply ports.

24. Apparatus according to claim 21, wherein a deflector plate is arranged between the outlet ends of each of the respective fuel tubes and the transverse center plane of the associated primary supply port, said deflector plate extending substantially parallel to the direction of flow of primary air through said primary supply port and projecting into said flame tube, said deflector plate preventing flow of fuel to secondary air being supplied to said flame tube.

25. Apparatus according to claim 21, wherein an arched baffle is arranged between the outlet end of each of the respective fuel tubes and the transverse center plane of the associated primary supply port, said baffle extending from adjacent said outlet end of the respective fuel tube and projecting into said flame tube for preventing flow of fuel to secondary air being supplied to said flame tube.

* * * * *